United States Patent [19]

Wich

[11] 3,981,214

[45] Sept. 21, 1976

[54] CODE KEY CUTTER HAVING INTERCHANGEABLE ATTACHMENTS

[76] Inventor: Horst W. Wich, 816 Brent St., South Pasadena, Calif. 91030

[22] Filed: Nov. 13, 1975

[21] Appl. No.: 631,502

[52] U.S. Cl. ..... 83/414; 83/917; 214/1.3

[51] Int. Cl.[2] ..... B26F 1/12

[58] Field of Search ..... 83/413, 414, 917; 214/1.1, 1.3

[56] References Cited

UNITED STATES PATENTS 2,731,087 1/1956 Cole ..... 83/917 X

*Primary Examiner*—J. M. Meister

*Attorney, Agent, or Firm*—Gene W. Arant

[57] ABSTRACT

A key cutting machine for making coded cuts in a key blank having interchangeable depth control attachments as well as interchangeable punch and die attachments, so that any type of standard key may be cut simply by utilizing the appropriate set of attachments.

12 Claims, 7 Drawing Figures

CODE KEY CUTTER HAVING INTERCHANGEABLE ATTACHMENTS

BACKGROUND OF THE INVENTION

The coding of the various notches in a key in accordance with a predetermined numerical formula is standard industry practice. However, there are several different perameters upon which the formula is based and these perameters vary from one standard type of key to another. For example, in comparing two standard types of keys, the longitudinal separation between the notches may have a standard value for each of the keys but this separation distance may be different for the two types of keys. The ratio instead of being 1:1 might be 1.1:1 or might be 1.25:1, for example. Also for a given type of key a notch having two units of depth would be precisely twice as deep as a notch having one unit of depth, but the unit of depth value would not be the same as on another standard type of key. Here again the ratio instead of being 1:1 might be significantly greater or significantly less than that.

In providing key cutting machines which will cut key blanks in accordance with a particular numerical combination or code it has, therefore, been necessary to provide a different machine for each standard type of key. Thus a machine which will cut Schlage keys in accordance with the code would not be used for cutting Kwick-Set keys in accordance with the code, and vice versa.

SUMMARY OF THE INVENTION

In accordance with the present invention I have provided a key cutting machine for cutting key blanks in accordance with a predetermined code or combination, which is universally adaptable to all the standard types of keys. Specifically, this machine may be used with any one of about 50 standard types of keys.

The present invention provides a simplified depth control mechanism for controlling the cutting depth of a die and punch at each notch location of a key blank. The depth control mechanism includes a removable depth gauge. The depth gauge comprises a removable attachment having a sloped surface whose angle of slope may be selected to provide the proper depth increments for the particular standard key to be notched. Furthermore, a removable die is provided, having an associated punch whose pattern is conformable to that of the die. There are also associated with the die a carriage, a carriage advance, and a ratchet mechanism, for controlling the advancement of the carriage in increments which correspond precisely to the longitudinal separation distance between notch locations on the particular standard type of key.

Thus, the object and purpose of the invention is to provide a code key cutting machine which is easily adaptable to any one of a large number of different standard types of keys.

DRAWING SUMMARY

PREFERRED EMBODIMENT

Figure 1:
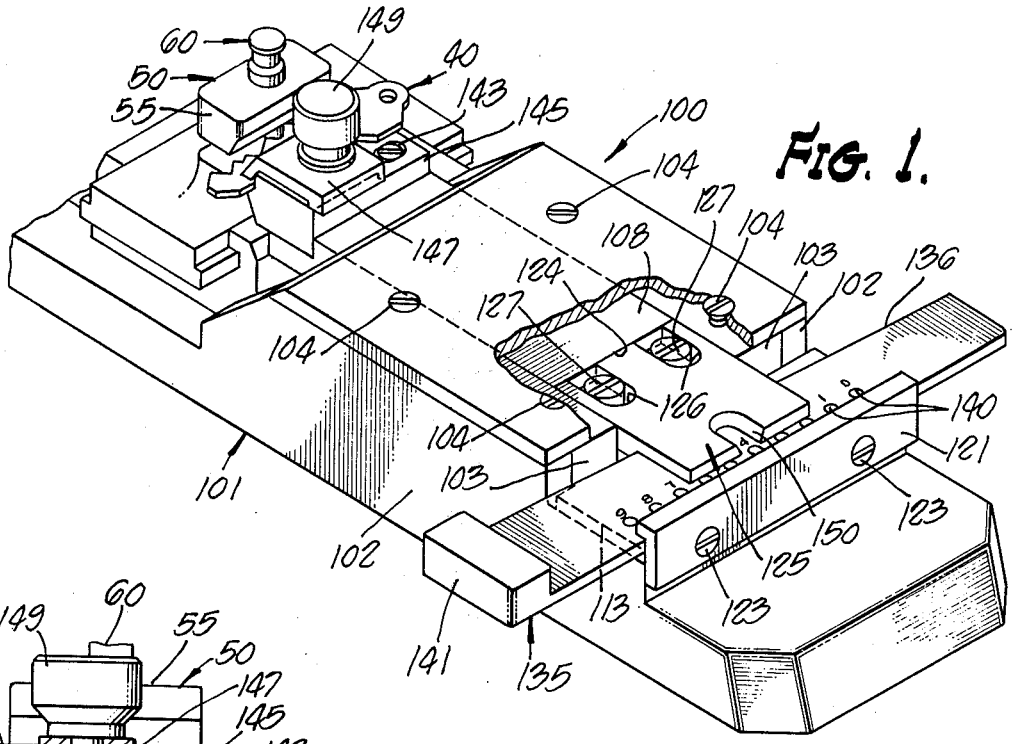
FIG. 1 is a perspective view of the depth control mechanism of the key cutting machine of the present invention.
Figure 3:
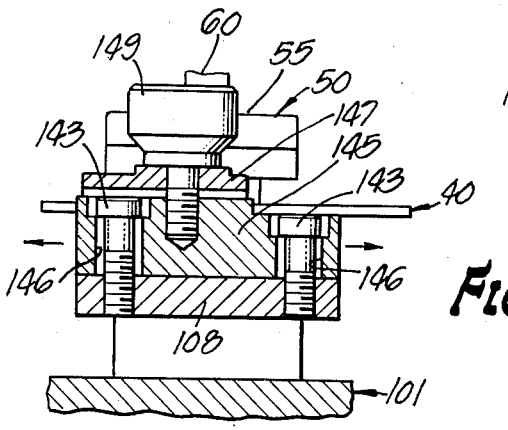
FIG. 3 is a transverse cross-sectional view taken on the line 3—3 of FIG. 2.
Figure 2:
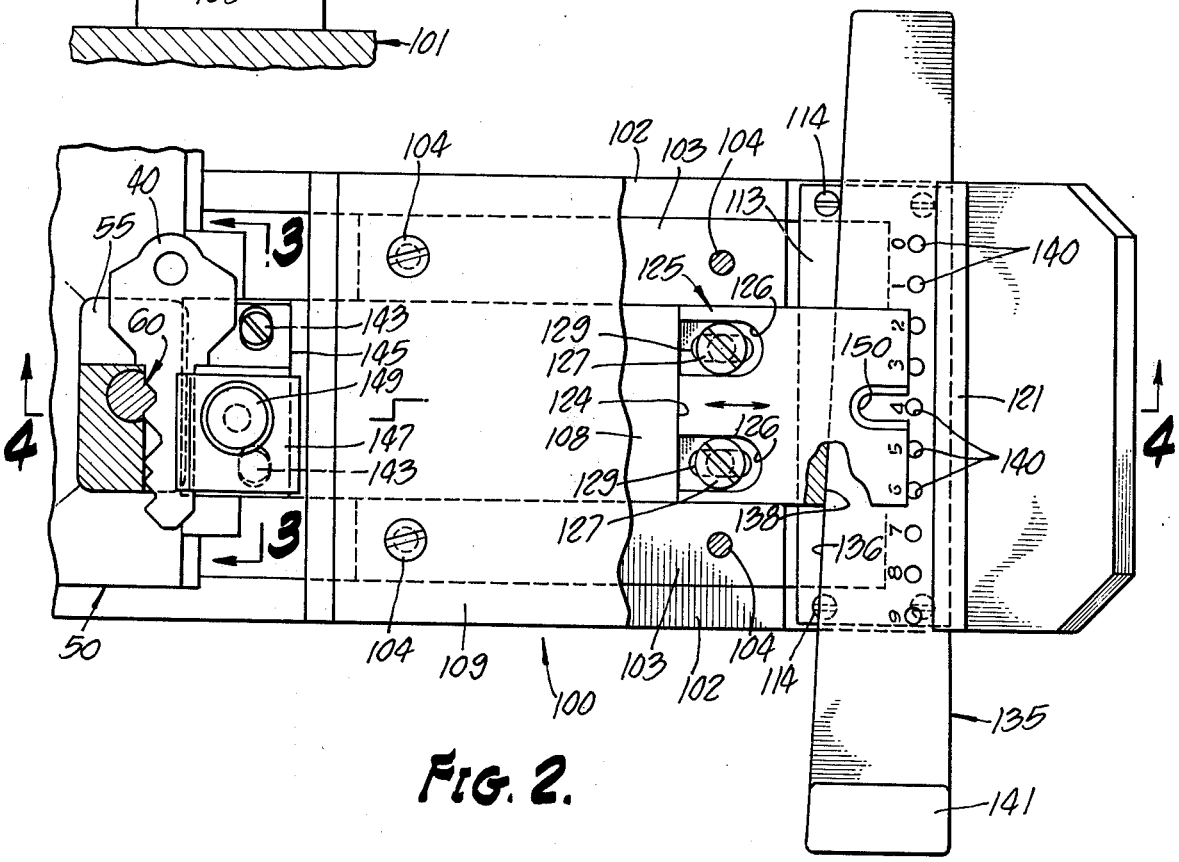
FIG. 2 is a plan view of the depth control mechanism.
Figure 4:
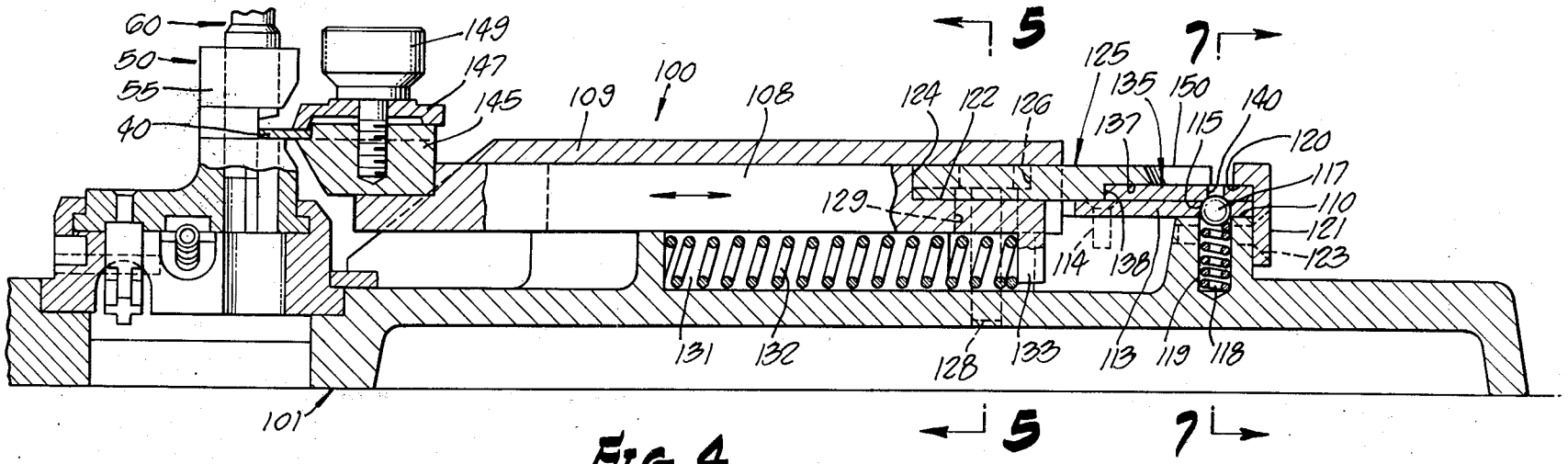
FIG. 4 is an elevational cross-sectional view taken on the line 4—4 of FIG. 2.
Figure 7:
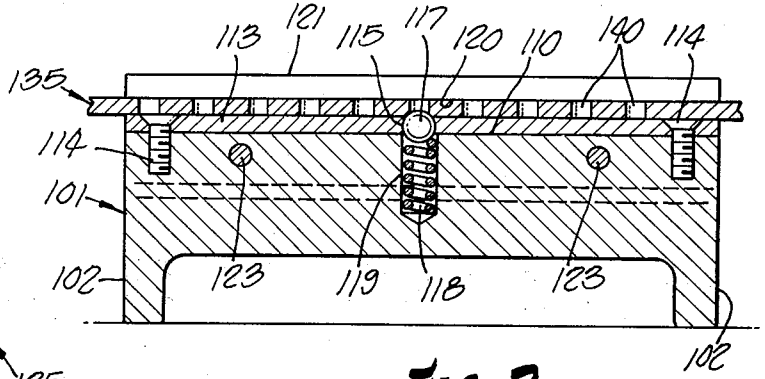
FIG. 7 is a transverse cross-sectional view taken on the line 7—7 of FIG. 4.
Figure 6:
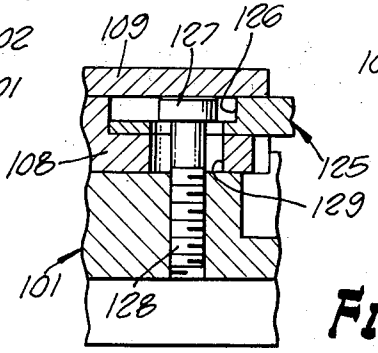
FIG. 6 is a fragmentary sectional view taken on the line 6—6 of FIG. 5.
Figure 5:
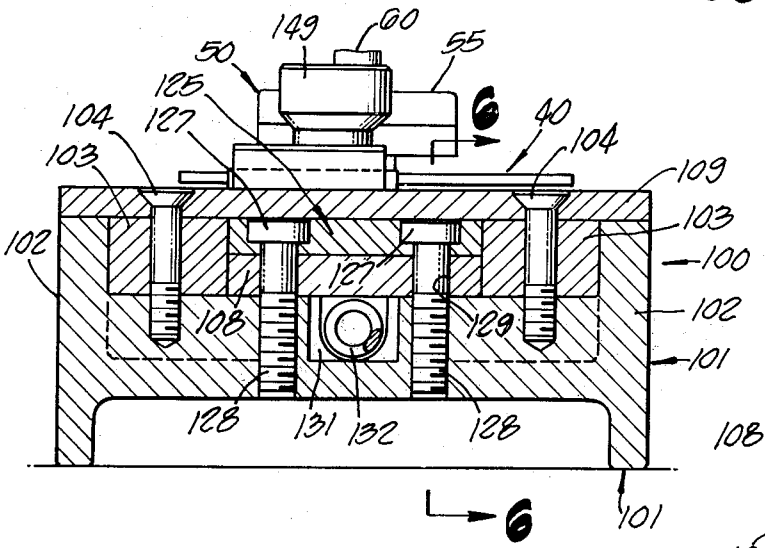
FIG. 5 is a transverse cross-sectional view taken on the line 5—5 of FIG. 4.

A code key cutting machine having an interchangeable feature for the die carriage which is movable relative to the key blank and for the depth control mechanism for controlling the depth of cut is disclosed by reference to my prior copending application Ser. No. 615,396, filed Sept. 22, 1975. The present application is now directed to such a code key cutter which additionally includes a modification of the depth control mechanism as disclosed in the referenced patent.

Referring to the drawings the depth control mechanism 100 includes an elongated base 101 having sidewalls 102 which define a longitudinally extending channel opening on the upper portion thereof. A pair of guideways 103 are fitted against the respective sides of the longitudinal channel opening. A top plate 109 extending across the top of the sidewalls 102 provides a cover for the channel opening. The top plate 109 and the guideways 103 are secured in position on the base 101 by screws 104. A key carriage 108 is positioned to slide within the longitudinal opening so formed between the guideways 103, underneath plate 109.

The rear portion of the base 101, rearwardly of the channel opening, is provided with a flat, support surface 110 which is elevated slightly above the bottom of the channel opening. A support plate 113 is secured on the support surface 110 by screws 114. Support plate 113 has a hole 115 centrally positioned near the rear thereof. The bottom of hole 115 is larger than the top thereof such that a ball 117 can be supported therein by a coil spring 118 seated in an opening 119 in the base such that the ball 117 juts slightly above the surface of the support place 113. An L-shaped backstop 121 is attached to the back of support surface 110 of the base by screw 123 such that the upper projecting portion 20 thereof is spaced above the support plate 113.

The key carriage 108 has a recess 122 formed on the upper rear portion thereof with a right angle shoulder 124 for engaging the front end of a coupling member 125. The coupling member 125 has a pair of spaced elongated holes 126 on the front portion thereof. The holes 126 are recessed for seating the heads 127 of bolts 128 which extend therethrough and on through elongated holes 129 in the key carriage 108 so as to threadedly engage the base 101. It should be noted that the key carriage 108 and the coupling member 125 are able to freely move longitudinally in either direction in the channel opening of the base to the limits of their elongated holes.

An elongated well 131 is centrally formed on the bottom of the base 101. Located in the well 131 is a compression spring 132 the forward end of which bears against the forward end of the well and the rear end of which contacts a downwardly projecting lug 133 on the key carriage 108 thus urging the key carriage 108 rearwardly.

The key cutting depth selection appartus includes a depth gauge 135 in the form of a long, flat, stiff strip of metal. The depth gauge 135 is generally rectangular in shape except that the front longitudinal edge 136 thereof is inclined at a slight angle of 2 ½° relative to the rear longitudinal edge thereof. A plurality of indexing holes 140 are spaced along the length of the depth gauge. The coupling member 125 has an undercut 137 on the rear portion thereof which forms a sloped shoulder 138 of 2 ½°. The narrow end of the depth gauge is inserted in the lateral opening defined by the undercut 137 on the coupling member 125 and the projected portion 120 on the backstop 121 with the sloped front longitudinal edge 136 of the depth gauge engaging the similar sloped rear shoulder 138 on the coupling member 125.

The key carriage 108 which contacts the coupling member 125 is spring loaded by spring 132 so as to be always urged in the direction towards the backstop 121. This assures that the depth gauge 135 will always be held in place in the manner indicated above, and also that the depth-measurement provided by the depth gauge 135 will be an accurate one since the spring pressure is sufficient to eliminate any significant error in the positioning action.

It should now be clearly understood that the depth gauge 135 when manually moved laterally inwardly on the base by use of its enlarged end 141, functions as a linear cam in that it drives the coupling member 125 longitudinally forwardly, and the latter, in turn, drives the key carriage 108 along the guideways 103, against the spring 132, towards the punch 60 and die carriage 50. On the other hand, when the depth gauge is manually moved laterally outwardly on the base, the spring 132 moves the key carriage 108 and the coupler member 125 longitudinally rearwardly, such that the latter maintains its engagement with the depth gauge. As the depth gauge 135 is moved laterally in the base 101 it slides on the support plate 113 with the indexing holes 140 thereof successively engaging the spring loaded ball 117.

As will be more clearly explained hereinafter, the use of the coupling member 125 makes it relatively easy to provide the code key cutting machine of the present invention with a depth gauge 135 having a sloped longitudinal edge 136 and indexing holes 140 spaced, as needed, to enable the notching of different types of keys by the machine.

Attached to the front of the key carriage 108 by screws 143 is a key mount 145. A clamp 147 held on the top of the key mount 145 by a thumbscrew 149 is provided with a front projecting surface that bears against the upper longitudinal side of the key blank 40 which is abutting up against a shoulder on the upper front surface of the key mount 145. When the thumbscrew 149 is tightened the key blank 40 is secured in position to be punched by the punch 60 and the die 55. The holes 146 on the key mount for the screws 143 are oversized to permit lateral adjustment of the key mount 145 relative to the key carriage, as needed, to correct for shoulder adjustment of the key blank 40.

It should be noted that the depth gauge 135 has a series of digit markings 0 through 9, inclusive, which are located opposite the indexing holes 140 provided along the length of the rear edge thereof. These digit markings indicate the depth of a cut to be made on the key blank 40 as a result of the positioning of the depth gauge. The 9 digit marking is near the widest end of the gauge while the 0 digit marking is near the narrowest end. It should be noted that this particular depth gauge 135 is for the Schlage key and that is why it has digit markings 0 through 9, inclusive, thereon. For some other make of keys the digit markings might be 0 through 7, inclusive, or 0 through 10, inclusive, for example.

The rear end of the coupling member 125 normally covers the digit markings on the depth gauge with the exception of an index slot 150 on the center of the rear edge of the coupling member which serves as a window for selected one of the digit markings. Thus, to set the machine so that it will cut a predetermined depth on the key blank 40, the depth gauge 135 is slid longitudinally on the flat surface of the support plate 113 in order to align a particular digit marking thereon approximately with the index slot 150 on the coupling member 125. Because of the spring loaded ball 117 jutting above the support plate 113, the depth gauge 135 clicks as the ball 117 enters each of the indexing holes 140 at the various digit positions. Thus when the desired digit setting is reached, its indexing hole 140 in conjunction with the spring loaded ball 117 provides a precise positioning action for the depth gauge. In this manner the depth gauge 135 can be manually set for any desired depth within the available range. Thus, for the digit 9 setting the key carriage 108 will be urged to its extreme position towards the die 55 and punch 60, and for the 0 digit setting the key carriage 108 will be permitted to assume its position furthest away from the die 55 and punch 60.

The overall operation of the key cutting machine for cutting a key blank 40 according to the code will next be described. Before a particular notch is cut on the key blank 40, the operator simply sets the depth gauge 135 to the digit marking corresponding to the depth to be set for that notch position. The net result of the change in position of the depth gauge 135 is that is changes position of the longitudinal edge of the key blank 40 relative to the die 55 and punch 60. Thus it makes the die 55 and punch 60 cut either deeper or shallower than the time before, depending on which way the operator has manually moved the depth gauge 135. For example, the depth gauge can be manually set for the digit 3 and then the operating handle 20 (see referenced U.S. Pat. No. 615,396) is depressed to punch the notch. As the handle 20 is returned, the die carriage 50 is automatically incrementally moved to a succeeding notch position along the longitudinal edge of the key blank 40. Then the depth gauge 135 can be manually set for the digit 5, for example, and then the operating handle 20 is again depressed for cutting the notch at that position.

It should now be evident that in the depth control mechanism 100 of the present invention, the key blank 40 is located and held in position relative to the punch 60 and the die 55. Punch 60 and die 55 are able to move laterally on a die carriage 50 formed integrally with the die 55 for punching the different notch positions along the key blank 40 to the extent determined by the setting of the depth gauge 135 for each punch. The application Pat. No. 615,396 incorporated herein by reference discloses the details of the punch 60, the die 55 and the die carriage 50 associated with the die, and the automatic incremental movement of the latter in a direction along the longitudinal length of the key blank 40 each time the handle 20 of the machine is depressed.

It should now be evident that the depth control mechanism 100 as described herein is not only very simple to construct and operate but has the desired advantage that the depth gauge 135 together with the coupling member 125 attached by bolts 128 to the key carriage 108 can be readily replaced to provide for cutting different types of keys.

While a particular embodiment of the invention has been described in detail in order to comply with the disclosure requirements of the patent laws, it will nevertheless be understood that the depth and scope of the invention are to be limited only in accordance with the following claims.

What is claimed is:

1. A key cutting machine comprising:

a key carriage adapted to support a key blank thereon with the operative edge of the key blank projecting beyond the carriage;

a die carriage having a die and a punch supported thereon, said punch being reciprocable within said die;

means supporting said key carriage juxtaposition to said die carriage so that the operative edge of the key blank may be interposed between said punch and said die;

means for adjusting the position of said die carriage relative to said key carriage in a direction longitudinally of the key blank, so as to select a longitudinal position on the key blank at which end a notch is to be cut;

means for adjusting the position of said key carriage relative to said die carriage in a direction perpendicular to the operative edge of the key blank in order to set the depth of the notch that is to be cut, said key carriage adjusting means including a cam which is coupled to said key carriage and extends generally parallel to the longitudinal axis of the key blank but at an acute angle relative thereto, and drive means cooperable with said cam for driving said key carriage either towards or away from said key carriage; and means manually operable after both of said carriages have been positioned for driving said punch into said die to cut the notch.

2. A key cutting machine as claimed in claim 1 which further includes indicating means associated with said cam drive means for indicating a selective one of a plurality of discrete adjustment positions of the key carriage which respectively correspond to the discrete cutting depths on the key blank.

3. A key cutting machine as claimed in claim 1 wherein said cam is removable from said key carriage adjusting means thereby permitting the substitution of a different cam which will provide different cutting depths at the corresponding notch locations on the key blank.

4. The invention in accordance with claim 1 including a coupling member for coupling said cam to said key carriage.

5. The invention in accordance with claim 1 wherein said drive means includes means on said cam by which said cam is manually moved parallel to the longitudinal axis of the key blank.

6. In a key cutting machine, the combination comprising:

a base;

a key carriage movable on said base, said key carriage adapted to support a key blank thereon with the operative edge of the key blank projecting beyond the carriage;

a die carriage having a die and a punch movable within said die, said die carriage being positioned so that the operative edge of the key blank may be interposed between said die and said punch;

a backstop on said base;

a coupling member engaging said key carriage; and a depth gauge having a sloped longitudinal edge surface, said depth gauge engagingly interposed between said coupling member and said backstop;

whereby moving said depth gauge laterally relative to said base provides for adjusting the position of said key carriage on said base relative to said die carriage in a direction perpendicular to the operative edge of the key blank in order to select the depth of a notch that is to be cut on the key blank by said die and punch.

7. In a key cutting machine as claimed in claim 6 wherein said depth gauge has a plurality of indexing holes along the length thereof; and said base has a spring loaded ball thereon which engages the indexing holes as the depth gauge is laterally moved relative thereto for indicating discrete adjustment positions of the key carriage which respectively correspond to discrete cutting depths on the key blank.

8. In a key cutting machine as claimed in claim 6 wherein said coupling member has a sloped edge surface which corresponds to and engages the sloped longitudinal edge surface of said depth gauge.

9. In a key cutting machine as claimed in claim 6 wherein said base includes a spring for biasing said key carriage toward said backstop.

10. In a key cutting machine as claimed in claim 6 wherein said coupling member and said depth gauge are readily removable from their position between said key carriage and said backstop, thereby permitting the substitution of a different coupling member and depth gauge which will provide different cutting depths at notches that are to be cut on the key blank by said die and punch.

11. A digitally adjustable cam mechanism comprising:

a fixed stop;

a movable member;

means mounting said movable member for slidable movement towards or away from said stop;

spring means urging said movable member towards said stop;

a wedge-shaped cam member disposed between said stop and said movable member, being mounted for slidable movement in a direction substantially perpendicular to the direction of movement of said movable member; and indexing means for locking said cam member in a selected one of a plurality of predetermined positions which are equally spaced along the path of movement of said cam member.

12. The mechanism of claim 11 wherein said locking means includes a series of holes formed in said cam member, and a spring-loaded plunger over which said holes pass in sequence when said cam member moves.

* * * * *